US009052069B2

(12) United States Patent
Romas et al.

(10) Patent No.: US 9,052,069 B2
(45) Date of Patent: Jun. 9, 2015

(54) SYSTEM AND METHOD FOR PROVIDING LED TUBE LIGHTS WITH INTEGRATED SENSORS

(71) Applicant: Lockheed Martin Corporation, Bethesda, MD (US)

(72) Inventors: Gregory G. Romas, Coppell, TX (US); Becky Wallace, Irving, TX (US); Jatin N. Mehta, Arlington, TX (US); David L. Hoelscher, Arlington, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 168 days.

(21) Appl. No.: 13/772,480

(22) Filed: Feb. 21, 2013

(65) Prior Publication Data

US 2014/0233226 A1 Aug. 21, 2014

(51) Int. Cl.

| | |
|---|---|
| ***F21V 33/00*** | (2006.01) |
| ***F21V 19/00*** | (2006.01) |
| ***F21K 99/00*** | (2010.01) |
| ***F21V 23/00*** | (2006.01) |
| ***F21V 23/04*** | (2006.01) |
| *F21Y 101/02* | (2006.01) |
| *F21Y 105/00* | (2006.01) |

(52) U.S. Cl.

CPC ..... *F21K 9/17* (2013.01); *Y10T 29/4913* (2015.01); *F21V 23/005* (2013.01); *F21V 23/0442* (2013.01); *F21Y 2101/02* (2013.01); *F21Y 2105/001* (2013.01)

(58) Field of Classification Search

None

See application file for complete search history.

(56) References Cited

U.S. PATENT DOCUMENTS

| | | | | |
|---|---|---|---|---|
| 5,276,434 | A | 1/1994 | Brooks et al. | |
| 6,172,759 | B1 | 1/2001 | Goldstein | |
| 6,810,309 | B2 | 10/2004 | Sadler et al. | |
| 6,850,013 | B1 | 2/2005 | Ashley et al. | |
| 7,612,687 | B2 | 11/2009 | Nakamura | |
| 8,147,091 | B2 * | 4/2012 | Hsia et al. | 362/221 |
| 2005/0012467 | A1 | 1/2005 | Nemirow et al. | |
| 2005/0057926 | A1 | 3/2005 | McCoy | |
| 2005/0200143 | A1 | 9/2005 | Maestas | |
| 2005/0219860 | A1 * | 10/2005 | Schexnaider | 362/601 |
| 2008/0037245 | A1 * | 2/2008 | Chan | 362/218 |
| 2008/0182215 | A1 | 7/2008 | Sid | |
| 2010/0117558 | A1 * | 5/2010 | Lee | 315/294 |
| 2011/0038115 | A1 | 2/2011 | Halkosaari | |
| 2013/0113002 | A1 * | 5/2013 | Radermacher | 257/88 |
| 2013/0285827 | A1 * | 10/2013 | Ivey et al. | 340/691.1 |
| 2013/0335959 | A1 * | 12/2013 | Hsia et al. | 362/221 |
| 2013/0343079 | A1 * | 12/2013 | Unger et al. | 362/555 |

* cited by examiner

*Primary Examiner* — Ashok Patel

(74) *Attorney, Agent, or Firm* — Terry M. Sanks, Esq.; Beusse Wolter Sanks & Maire, P.A.

(57) ABSTRACT

A system is presented including a tube light mounted in a tube light socket. The tube light includes a printed wiring board, one or more LEDs mounted to the printed wiring board, and one or more sensors mounted to the printed wiring board. The tube light also includes a power supply mounted to the printed wiring board, such that the power supply is connected to the tube light socket to supply a direct current voltage signal to the printed wiring board. A method is also provided for forming the tube light and mounting the tube light into the tube light socket.

16 Claims, 5 Drawing Sheets

SYSTEM AND METHOD FOR PROVIDING LED TUBE LIGHTS WITH INTEGRATED SENSORS

BACKGROUND

Embodiments relate generally to a tube light, and more particularly, to a system and method for providing light emitting diode (LED) tube lights with integrated sensors.

Building operators routinely try to install additional sensors of various types, to increase sensor coverage area throughout their buildings. For example, operators of commercial buildings attempt to install additional safety sensors in their buildings, such as gas sensors and fire sensors, for the protection of their patrons and employees. In another example, operators of government buildings, such as airports, usually want additional security sensors, such as motion sensors and camera sensors, for example. However, these building operators discover that installation of these additional sensors is not practical, since such installation requires expensive installation of additional infrastructure, such as wiring, for example. Thus, it would be advantageous to provide a practical and cost effective method of installation for these additional sensors.

BRIEF DESCRIPTION

One embodiment is directed to a system including a tube light mounted in a tube light socket. The tube light includes a printed wiring board, one or more LEDs mounted to the printed wiring board, and one or more sensors mounted to the printed wiring board. The tube light also includes a power supply mounted to the printed wiring board, such that the power supply is connected to the tube light socket to supply a direct current voltage signal to the printed wiring board.

Another embodiment is directed to a system including a tube light mounted in a tube light socket. The tube light includes a printed wiring board and a power supply mounted to the printed wiring board. The power supply is connected to the tube light socket and configured to supply a direct current voltage signal to the printed wiring board.

Another embodiment is directed to a method including the step of forming a tube light. The forming of the tube light includes the steps of providing a printed wiring board and mounting a power supply to the printed wiring board. The method also includes the step of mounting the tube light into a tube light socket. The mounting of the tube light into the tube light socket includes the steps of connecting the power supply to the tube light socket and supplying a direct current voltage signal to the printed wiring board.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

As previously discussed, there is a need for a cost-effective installation method for sensors in buildings. The inventors recognized that, there is a growing trend to replace fluorescent tube lights of fluorescent tube light sockets with more efficient tube lights, such as LED tube lights. The inventors also recognized that, these more efficient LED tube lights have a significant amount of free space on their printed wiring boards that could be used to mount additional sensors. Thus, the inventor discovered that, in the process of replacing these fluorescent tube lights with the more efficient LED tube lights, additional sensors could be integrated into the LED tube lights, by mounting these additional sensors onto the printed wiring boards of the LED tube lights. The tube light and the integrated sensors are both powered from the fluorescent tube light socket and thus are both powered from the pre-existing wiring of the fluorescent tube light socket. Thus, additional sensors can be installed in fluorescent tube light sockets of a building, without the need for additional infrastructure such as additional wiring.

Figure 1:
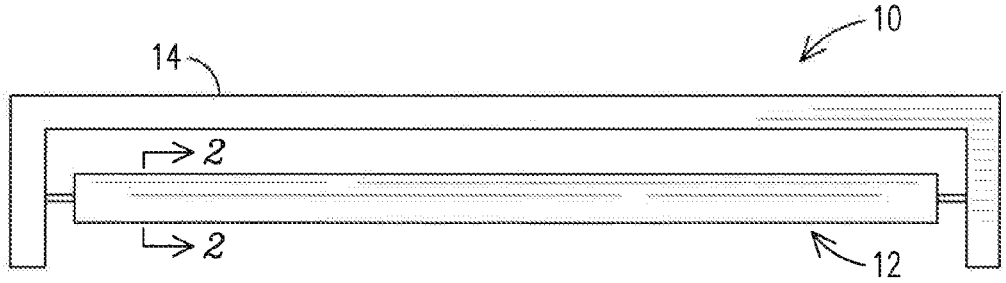
FIG. 1 discloses a plan view of a tube light mounted in a tube light socket.

FIG. 1 illustrates an embodiment of a system 10 including a tube light 12 that is configured to be mounted in a tube light socket 14. The tube light socket 14 may be a conventional fluorescent tube light socket, such as a socket sized to fit a T5 or T8 fluorescent tube light, for example. However, the embodiment of FIG. 1 is not limited to a tube light socket sized to fit a T5 or T8 fluorescent tube light and may be a tube light socket that is sized to fit other tube lights. The tube light 12 may be a light emitting diode (LED) tube light that is sized to fit the tube light socket 14.

Figure 2:
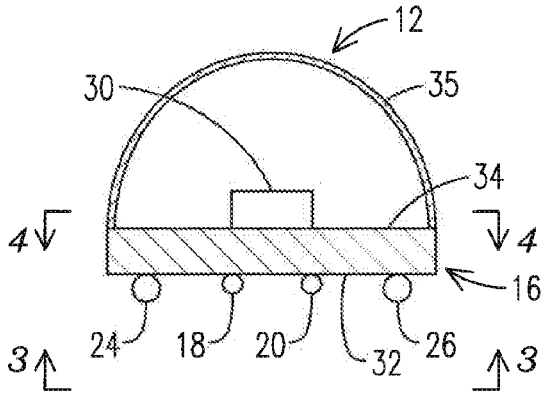
FIG. 2 discloses a cross-sectional view of the tube light of FIG. 1 taken along the line 2-2.

As illustrated in FIG. 2, the tube light 12 may include a printed wiring board 16, a plurality of LEDs 18, 20 mounted or attached to a front face 32 of the printed wiring board 16, and a plurality of sensors 24, 26 mounted or attached to the front face 32 of the printed wiring board 16. The tube light 12 may also include a power supply 30 that is mounted to a rear face 34 of the printed wiring board 16 that is opposite to the front face 32. Additionally, the embodiment may feature just the sensors 24, 26 being mounted to the front face 32 or the rear face 34, without LEDs 18, 20 being mounted to either of the front face 32 or the rear face 34. As appreciated by one skilled in the art, some tube light sockets 14 are configured to receive more than one tube light, and the embodiment includes an arrangement in which a first tube light with LEDs mounted to the printed wiring board is received within the tube light socket 14, and a second tube light with just sensors (no LEDs) is mounted to the printed wiring board and is also received within the tube light socket 14. As further illustrated in FIG. 2, a semi-circular backing 35 may be provided on the tube light 12, to act as a heat sink and dissipate heat generated in the LEDs 18 to the outside atmosphere.

Figure 3:
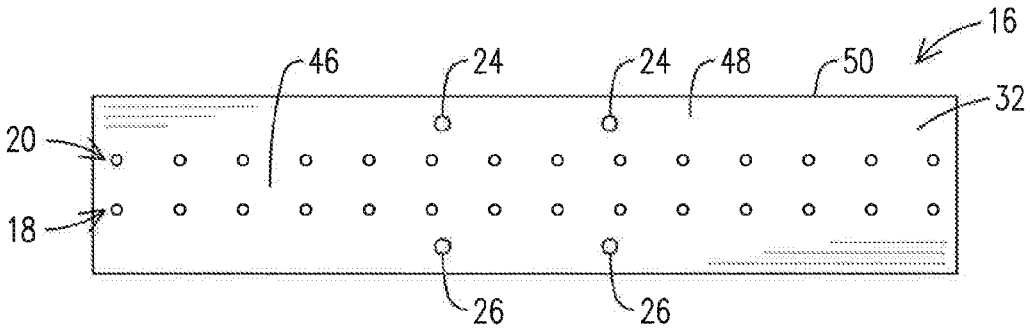
FIG. 3 discloses a plan view of a front face of a printed wiring board of the tube light of FIG. 2 taken along the line 3-3.

FIG. 3 illustrates the sensors 24, 26 arranged on the front face 32 of the printed wiring board 16. The sensors 24, 26 may be one or more of a gas sensor, a fire sensor, a temperature sensor, a motion sensor or a camera sensor, such as but not limited to a charge-coupled device (CCD) sensor. The embodiment of FIGS. 1-3 is not limited to this list of sensors, and may include any sensor that can be used in a building or structure for purposes of measuring a parameter to assist in the operation and/or maintenance of the building. As a non-limiting example, FIG. 2, the front face 32 of the tube light 12 may not be sealed, and thus the sensors 24, 26 can measure air parameters such as temperature and chemical properties, for example. In another embodiment, a fire sensor may be arranged on the front face 32, and consist of a sensor to detect smoke/fire, along with a transducer such as a speaker or a light, which alerts occupants of the building that a fire is present.

As illustrated in FIG. 3, the LEDs 18, 20 may be arranged in rows and may be mounted along an inner region 46 of the front face 32 of the printed wiring board 16. The sensors 24, 26 may be mounted to an outer region 48 of the front face 32 between the inner region 46 and an outer side 50 of the front face 32. Although FIG. 3 illustrates two rows of LEDs 18, 20 arranged along the inner region 46 of the front face 32, less or more than two rows of LEDs may be arranged along the front face 32, depending on the luminous requirements for the room housing the tube light socket 14. Thus, in a non-limiting example, three rows of LEDs may be arranged along the front face 32, if the two rows of LEDs 18, 20 do not satisfy the luminous requirements of the room, for example. Although FIG. 3 illustrates that the sensors 24, 26 are mounted at the outer region 48 between the inner region 46 and the outer side 50, this is merely one embodiment for arranging the LEDs and the sensors on the front face 32. Other embodiments for arranging the LEDs and the sensors on the front face 32 are discussed below.

Figure 4:
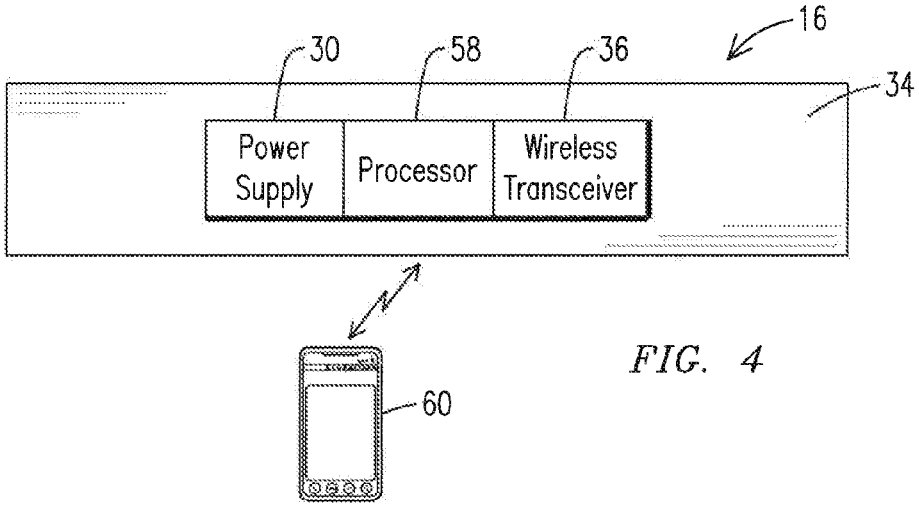
FIG. 4 discloses a plan view of a rear face of the printed wiring board of the tube light of FIG. 2 taken along the line 4-4.

As illustrated in FIG. 4, a processor 58 may be mounted to the rear face 34 of the printed wiring board 16, and a remote transmitter 60 is provided in wireless communication with the processor 58. As previously discussed, the sensors 24, 26 may be one or more of a gas sensor, a fire sensor, a temperature sensor, a motion sensor and a camera sensor, depending on the attributes of the room or area in which the tube light socket 14 is housed, and which parameters of the room need to be tracked by the operators of the building. Thus, the operators of the building can use the remote transmitter 60 to select which of a gas sensor, a fire sensor, a temperature sensor, a motion sensor and/or a camera sensor among the sensors 24, 26 are needed in the area. The operator of the building presses one or more buttons on the remote transmitter 60, which in-turn transmits one or more signals to the processor 58, after which the processor 58 selectively activates or deactivates the sensors 24, 26. In one non-limiting example, an operator of a commercial building may use the remote transmitter 60 to communicate with the processor 58, so that the processor 58 activates temperature sensors and fire sensors among the sensors 24, 26 on the printed wiring board 16, so the operator of the building can further ensure the safety and comfort of the patrons of the building. In another non-limiting example, an operator of a government building such as an airport may use the remote transmitter 60 to communicate with the processor 58, so that the processor 58 activates camera sensors and motion sensors among the sensors 24, 26 on the printed wiring board 16, so the operator can further enhance security measures at the building. Thus, in the above non-limiting example, the location of the tube light socket 14 (e.g., commercial building, government building, etc) may determine which sensors 24, 26 the operator needs, and thus which signals are transmitted by the remote transmitter 60 to the processor 58, to active these specific sensors 24, 26.

Although the embodiment of FIGS. 1-4 discuss that LEDs 18, 20 and sensors 24, 26 may be mounted to the front face 32 and a power supply 30 may be mounted to the rear face 34 of the printed wiring board 16, the embodiment is not limited to this arrangement and may feature either or both of the LEDs 18,20 and sensors 24,26 being mounted to the rear face 34 and the power supply 30 mounted to the front face 32.

FIG. 4 illustrates that a power supply 30 may also be mounted to the rear face 34 of the printed wiring board 16. As disclosed in more detail below, the power supply 30 may receive an A/C voltage signal where the A/C voltage signal may be converted to a D/C voltage signal. As is also explained in further detail below, the rear face 34 of the printed wiring board 16 may also include a wireless transceiver 36 that uploads or downloads data from the sensors 24.

Figure 5:
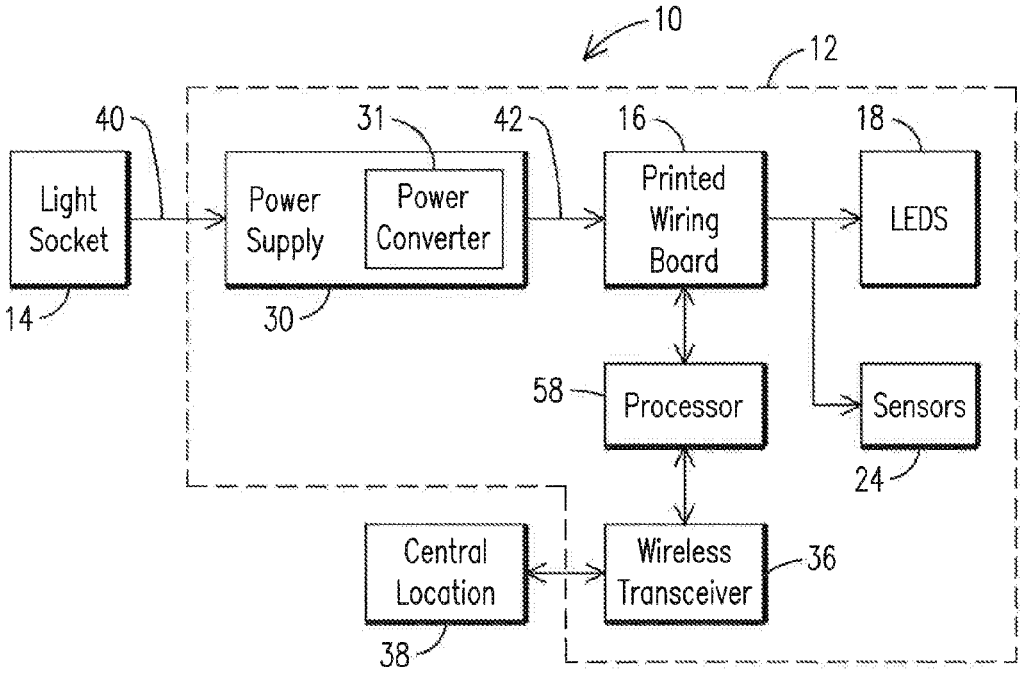
FIG. 5 discloses a schematic view of the components of the tube light of FIG. 1.

FIG. 5 illustrates a connection between the components of the system 10. The power supply 30 mounted to the rear face 34 of the printed wiring board 16 may be connected to the tube light socket 14 and receive an A/C voltage signal 40 from the tube light socket 14. As further illustrated in FIG. 5, the power supply 30 may include a power converter 31, such as a rectifier, which converts the incoming A/C voltage signal 40 into a D/C voltage signal 42 that is output from the power supply 30 to the printed wiring board 16. As a non-limiting example, the incoming A/C voltage signal 40 may be a 120V A/C signal, and the outgoing D/C voltage signal may be one of a 5V, 8V or 12V D/C signal. In an embodiment, the incoming AIC voltage signal 40 provides 40 W of power and the LEDs 18, 20 only require 12 W of power, which leaves an ample amount of surplus power for the sensors 24, 26.

A wireless transceiver 36 that may upload or download data from the sensors 24 is also illustrated in FIG. 5. The wireless transceiver 36 may download data from the sensors 24, and transmit the sensor data to a central location 38, where the sensor data may be analyzed. As a non-limiting example, the central location 38 may be a security office at an airport, where the wireless transceiver 36 transmits data from a camera sensor 24, so that security personnel at the security office can monitor the data. In another non-limiting example, the central location 38 may be an air conditioning unit at a commercial building, where the wireless transceiver 36 transmits data from a temperature sensor 24, so that the air conditioning unit can maintain the indoor temperature of the commercial building within a desired range.

Figure 6:
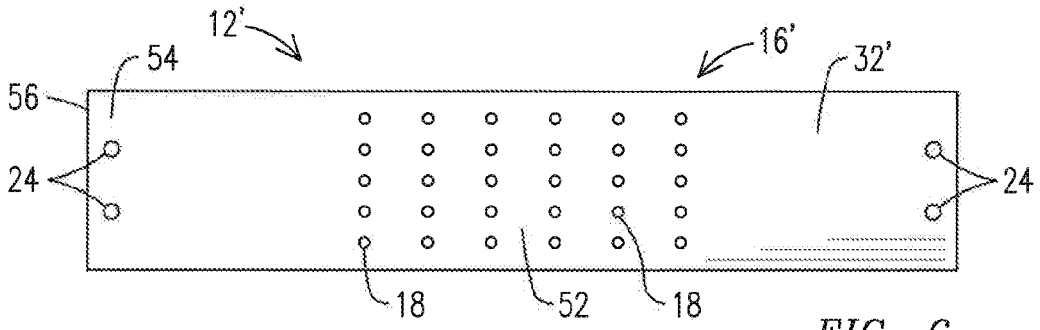
FIG. 6 discloses a plan view of a front face of an alternate printed wiring board of the tube light of FIG. 2.

As previously discussed, positioning the sensors 24, 26 on the outer region 48 of the front face 32 is merely a non-limiting example of how the sensors 24, 26 may be arranged on the front face 32. FIG. 6 illustrates an alternative tube light 12' that may also be configured to be mounted in the tube light socket 14. The tube light 12' may include a printed circuit board. 16' with an alternative arrangement of the LEDs 18 and the sensors 24, where the LEDs 18 may be mounted on a central region 52 of the front face 32' of the printed circuit board 16' and the sensors 24 may be mounted on an outer region 54 of the front face 32' between the central region 52 and an outer end 56 of the front face 32'. In a non-limiting example, this arrangement may be employed for temperature sensors, since the LEDs 18 may generate some heat and it is advantageous to maximize the separation between the LEDs 18 and the temperature sensors 24, so that any heat radiated from the LEDs 18 has minimal effect on the measurement of the temperature sensors 24. In spite of the semi-circular backing 35 of the tube light 12 that acts as a heat sink, the arrangement of the LEDs 18 on the front face 32' in FIG. 6 may further minimize the impact of generated heat on the temperature sensors 24 that is not dissipated by the backing 35.

When using temperature sensors 24, a calibration stage may be performed to filter out noise from thermal effects of the electronics of the tube light 12. During the calibration stage, the measured temperature from the temperature sensor 24 may be compared with an actual temperature in the room, at incremental temperatures in an expected temperature range of the room in the building. Each pair of measured temperature and actual temperature may then be stored in a memory of the processor 58. During operation of the temperature sensor 24, the temperature sensor 24 may transmit the measured temperature to the processor 58, which in-turn may retrieve the actual temperature from its memory that corresponds to the received measured temperature. The processor 58 may then outputs the actual temperature.

As previously discussed and illustrated in FIG. 5, the power supply 30 may be connected to the tube light socket 14, and convert the incoming A/C voltage signal 40 into a D/C voltage signal 42, which is transmitted to the printed wiring board 16. The above embodiments of FIGS. 1-6 involve mounting LEDs 18, 20 and sensors 24, 26 to the printed wiring board 16, so that the D/C voltage signal 42 may be used to power the LEDs 18, 20 and the sensors 24, 26 through the printed wiring board 16. However, the embodiment is not limited to an arrangement in which the LEDs 18, 20 and/or sensors 24, 26 are powered with the D/C voltage signal.

Figure 7:
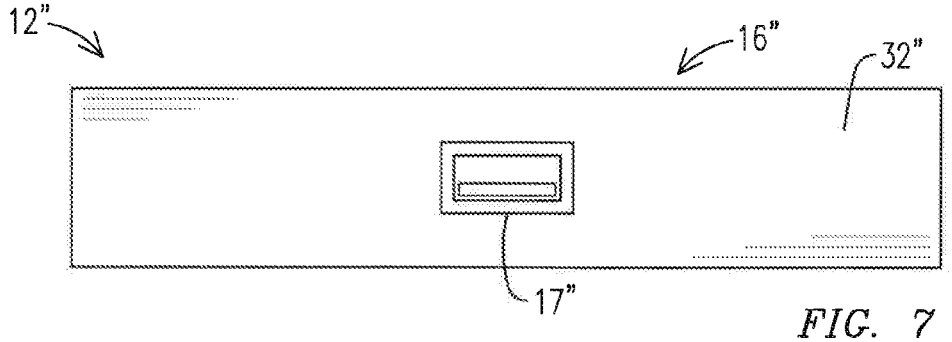
FIG. 7 discloses a plan view of a front face of an alternate printed wiring board of the tube light of FIG. 2.

As illustrated in FIG. 7, an alternative tube light 12" provided, which may be configured to be mounted in the tube light socket 14. The tube light 12" may include a printed wiring board 16" with the power supply 30 mounted to the rear face 34, to supply the D/C voltage signal 42 to the printed wiring board 16". The tube light 12" may also include an outlet 17" mounted to the front face 32" of the printed wiring board 16", so that the outlet 17" is rated at or below the DIG voltage. The illustrated outlet 17" may be a Universal Serial Bus (USB) outlet. However, the embodiment is not limited to a USB outlet and may be any type of electrical outlet that can be configured to be rated at or below the D/C voltage.

Additionally, the embodiment of FIG. 7 is not limited to one outlet and may include multiple outlets, such as multiple USB outlets, for example. Although FIG. 7 illustrates that solely the outlet 17" is mounted to the front face 32", the embodiment of FIG. 7 may provide that either the sensors 24, 26, the LEDs 18, 20 or a combination of both of the sensors 24,26 and the LEDs 18, 20 are mounted to the front face 32". As with the above embodiments of FIGS. 1-6, the wireless transceiver 36 may be mounted to the rear face 34 of the printed wiring board 16" so that the wireless transceiver 36 is configured to download data from the sensors 24, 26 and to transmit the data to a central location 38 for processing of the sensor data.

Figure 8:
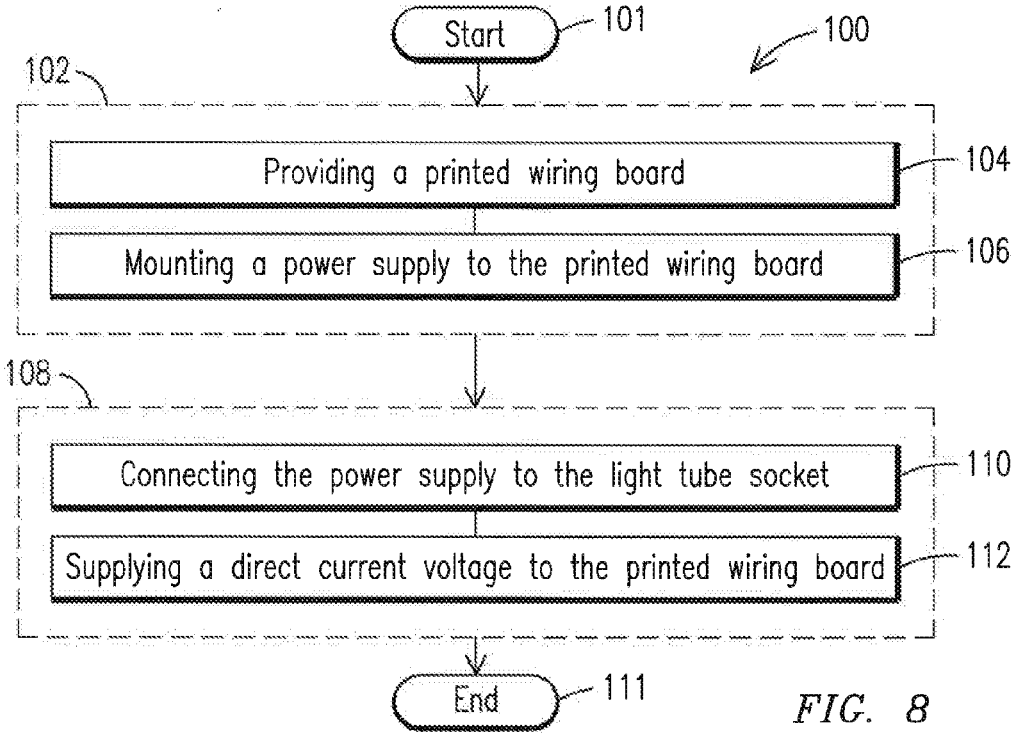
FIG. 8 discloses a flowchart depicting a method for forming a tube light and mounting the tube light into a tube light socket.
Figure 9A:
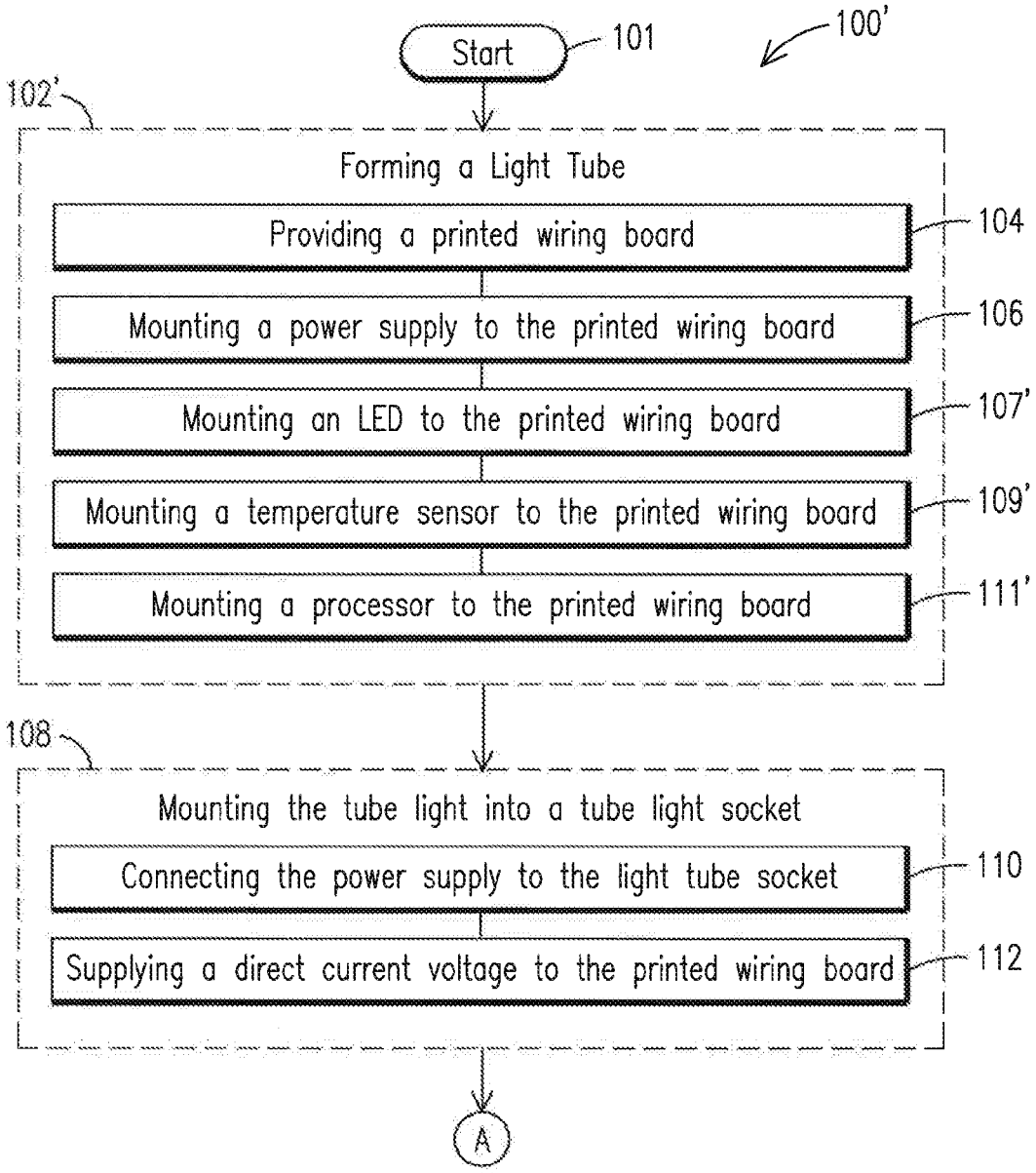
FIGS. 9A and 9B disclose a flowchart depicting a method for forming a tube light, mounting the tube light into a tube light socket, calibrating a temperature sensor on the tube light and using the temperature sensor.
Figure 9B:
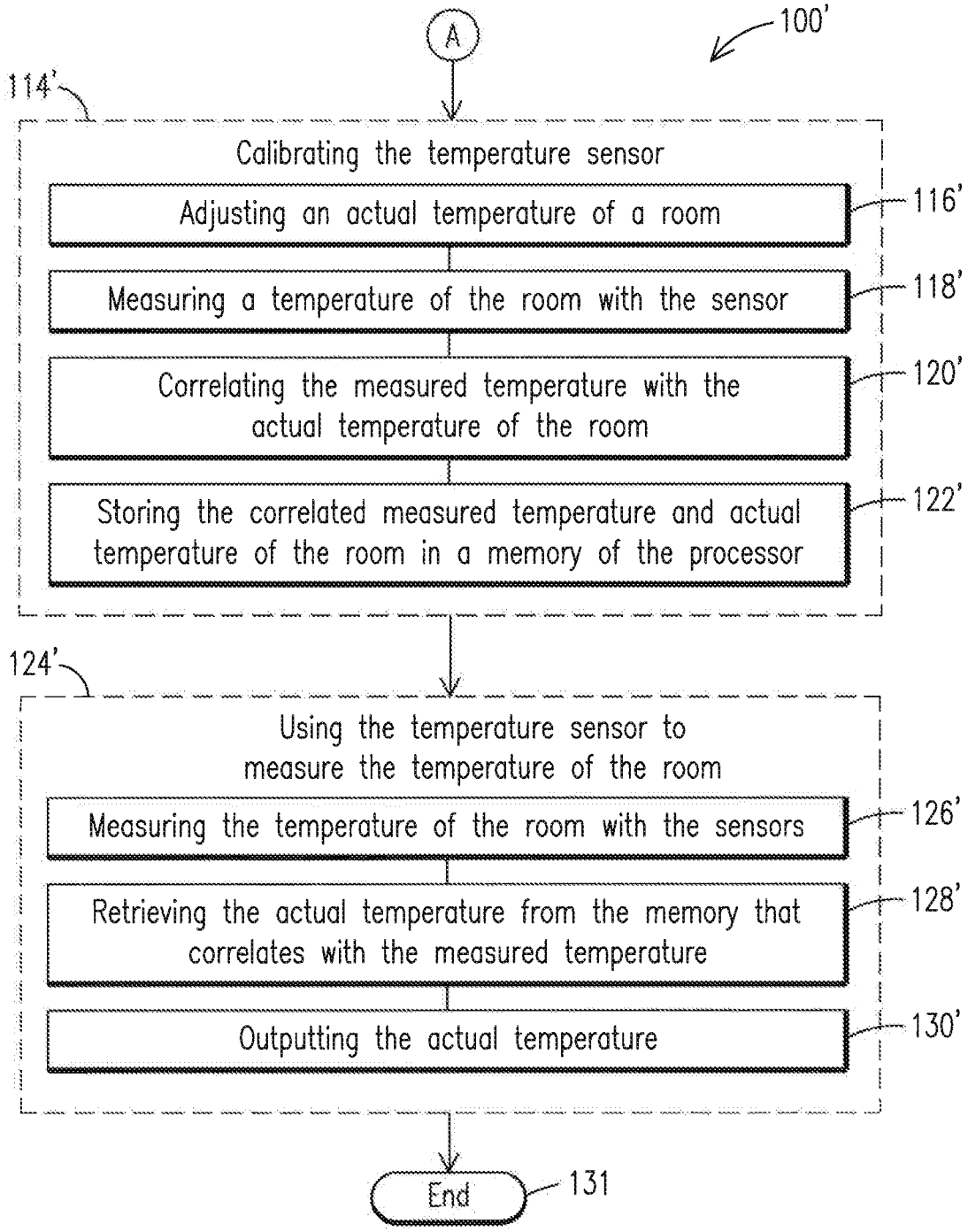

FIG. 8 illustrates a method 100 which begins at block 101 by forming 102 the tube light 12. The forming 102 step may involve the steps of providing 104 the printed wiring board 16 and mounting 106 the power supply 30 to the printed wiring board 16. As illustrated in another method 100' of FIGS. 9A and 9B, the forming 102' step may also include mounting 107' LEDs 18, 20 to the printed wiring board 16, mounting 109' temperature sensors 24, 26 to the printed wiring board 16 and mounting 111' the processor 58 to the printed wiring board 16. The method 100 may further include mounting 108 the tube light 12 into the tube light socket 14. The mounting 108 step may involve the steps of connecting 110 the power supply 30 to the tube light socket 14 and supplying 112 the direct current voltage signal 42 to the printed wiring board 16. As illustrated in FIGS. 9A and 9B, the additional method 100' may further include calibrating 114' the temperature sensors 24, 26. The calibrating 114' step may involve adjusting 116' an actual temperature of the room, measuring 118' a temperature of the room with the temperature sensors 24, 26, correlating 120' the measured temperature of the room with the actual temperature of the room and storing 122' the correlated measured temperature and the actual temperature of the room in a memory of the processor 58. The additional method 100' may further include using 124' the temperature sensors 24,26 to measure the temperature of the room. The using 124' step may involve measuring 126' the temperature of the room with the temperature sensors 24, 26, retrieving 128' the actual temperature from the memory of the processor 58 that correlates with the measured temperature, and outputting 130' the actual temperature, before the method ends at block 131.

While embodiments have been described with reference to various embodiments, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered. Moreover, unless specifically stated, any use of the terms first, second, etc., does not denote any order or importance, but rather the terms first, second, etc., are used to distinguish one element from another. Furthermore, the use of past or present tenses may be used interchangeably and should not be considered as limiting.

What is claimed is:

1. A system comprising:

a tube light attached in a tube light socket to receive power through the tube light socket, said tube light comprising:

a printed wiring board having a front face and a rear face;

at least one light emitting diode (LED) attached to the printed wiring board;

at least one sensor attached to the printed wiring board, the at least one sensor for measuring a parameter in an environment external to the system; and a power supply attached to the printed wiring board, said power supply connected to the tube light socket to receive power through the tube light socket and to supply a direct current voltage signal to the printed wiring board;

wherein the at least one LED and the at least one sensor are attached to the front face of the printed wiring board and the power supply is attached to the rear face of the printed wiring board; and wherein the at least one sensor is one of a gas sensor, a temperature sensor and a camera.

2. The system of claim 1, wherein the tube light comprises a plurality of LEDs and a plurality of sensors;

Wherein the plurality of LEDs are attached to a central region of the front face; and wherein the plurality of sensors are temperature sensors that are attached to an outer region between the central region and an outer end of the front face.

3. The system of claim 1, wherein the front face of the printed wiring board has direct access to the external environment to allow for direct contact between the at least one sensor and the parameter in the external environment.

4. The system of claim 1, further comprising a wireless transceiver attached to the printed wiring board, said wireless transceiver configured to download data from the at least one sensor, the data comprises a detected parameter to assist in at least one of an operation and maintenance of the environment external to the system, and said wireless transceiver configured to transmit the data to a central location.

5. The system of claim 1, wherein the power supply comprises a power converter configured to convert an incoming alternating voltage signal from the tube light socket to the direct current voltage signal supplied to the printed wiring board.

6. The system of claim 1, wherein the tube light comprises a plurality of LEDs and a plurality of sensors;

wherein the plurality of LEDs are arranged in a plurality of rows and attached along an inner region of the front face; and wherein the plurality of sensors are attached to an outer region between the inner region and an outer side of the front face.

7. The system of claim 6, further comprising:

a processor attached to the rear face; and a remote transmitter in wireless communication with the processor;

wherein the plurality of sensors comprise at least one of a gas sensor, a fire sensor, a temperature sensor, a motion sensor and a camera; and wherein the processor is configured to selectively activate and selectively deactivate each of the sensors based on a plurality of signals received from the remote transmitter.

8. The system of claim 7, wherein the remote transmitter is configured to transmit the plurality of signals based on a location of the tube light socket such that the sensors are selectively activated and deactivated based on the location of the tube light socket.

9. The system of claim 7, wherein the at least one sensor is a temperature sensor which is configured to be calibrated by adjusting an actual temperature of the environment external to the system by measuring a temperature of the environment external to the system with the temperature sensor, correlating with the processor the temperature measured in the room with the actual temperature of the environment external to the system with an actual temperature of the environment external to the system.

10. A system comprising:

a tube light mounted in a tube light socket to receive power delivered through the tube light socket, said tube light comprising:

a printed wiring board;

a power supply mounted to the printed wiring board, said power supply connected to the tube light socket to receive power delivered through the tube light socket and to supply a direct current voltage signal to the printed wiring board; and a high speed serial bus outlet mounted to the front face of the printed wiring board, said outlet rated at least one of at the direct current voltage and below the direct current voltage.

11. The system of claim 10, wherein said outlet is a Universal Serial Bus (USB) outlet.

12. The system of claim 10, further comprising at least one sensor, configured to measure a parameter in an environment external to the system, mounted to the printed wiring board.

13. The system of claim 12, further comprising at least one light emitting diode (LED) mounted to the printed wiring board.

14. The system of claim 13, wherein the printed wiring board comprises a front face and a rear face, wherein the at least one LED, at least one sensor and the outlet are mounted to the front face and wherein the power supply is mounted to the rear face.

15. The system of claim 12, further comprising a wireless transceiver mounted to the printed wiring board, said wireless transceiver configured to download data from the at least one sensor, and said wireless transceiver configured to transmit the data to a central location.

16. A method comprising:

forming a tube light, comprising:

providing a printed wiring board; and mounting a power supply to the printed wiring board;

mounting an outlet to the printed wiring board, said outlet is rated at the direct current voltage upon mounting the tube light into the tube light socket;

mounting at least one Light Emitting Diode (LED) to the printed wiring board;

mounting at least one sensor to the printed wiring board; and mounting a processor to the printed wiring board, wherein said sensor is a temperature sensor; and wherein said method further comprises:

calibrating the temperature sensor, including:

adjusting an actual temperature of a room housing the tube light socket;

measuring a temperature of the room with the temperature sensor;

correlating the temperature measured in the room with the actual temperature of the room; and storing the correlated measured temperature and the actual temperature of the room in a memory of the processor; and using the temperature sensor to measure the temperature of the room, comprising:

measuring the temperature of the room;

retrieving the actual temperature from the memory of the processor that correlates with the measured temperature; and outputting the actual temperature; and mounting the tube light into a tube light socket, comprising:

connecting the power supply to the tube light socket; and supplying a direct current voltage signal to the printed wiring board.

* * * * *

UNITED STATES PATENT AND TRADEMARK OFFICE

CERTIFICATE OF CORRECTION

PATENT NO. : 9,052,069 B2
APPLICATION NO. : 13/772480
DATED : June 9, 2015
INVENTOR(S) : Gregory G. Romas et al.

It is certified that error appears in the above-identified patent and that said Letters Patent is hereby corrected as shown below:

In the claims,

Column 6, claim 2, line 66, delete “Wherein” and insert --wherein--.

Column 8, claim 16, line 26, delete “and”.

Signed and Sealed this
Sixth Day of October, 2015

Michelle K. Lee

Michelle K. Lee
*Director of the United States Patent and Trademark Office*